United States Patent [19]

Raghavachari et al.

[11] 4,078,583

[45] Mar. 14, 1978

[54] AUTOMATIC FILLING MACHINE-VALVE ASSEMBLY

[75] Inventors: Srinivas T. Raghavachari, Chicago; Robert L. Striebel, II, Evanston, both of Ill.

[73] Assignee: MPL, Inc., Chicago, Ill.

[21] Appl. No.: 682,072

[22] Filed: Apr. 30, 1976

[51] Int. Cl.[2] ..... G01F 11/04; F16K 7/06

[52] U.S. Cl. ..... 137/636; 222/333; 251/9; 251/137

[58] Field of Search ..... 251/4–10, 251/137; 222/529, 333; 137/636

[56] References Cited

U.S. PATENT DOCUMENTS

| | | | |
|---|---|---|---|
| 3,450,152 | 6/1969 | Quellette | 251/9 X |
| 3,575,161 | 4/1971 | London | 137/636 |
| 3,963,151 | 6/1976 | North | 251/9 X |

FOREIGN PATENT DOCUMENTS

| | | | |
|---|---|---|---|
| 595,587 | 7/1959 | Italy | 251/137 |

*Primary Examiner*—Martin P. Schwadron
*Assistant Examiner*—Richard Gerard
*Attorney, Agent, or Firm*—Kinzer, Plyer, Dorn & McEachran

[57] ABSTRACT

A valving mechanism for an automatic filling machine for transferring liquid pre-measured doses to receptacles such as oral dispensers, nebulizer injectors, vials and hypodermic syringes. The automatic filling machine includes a piston type pump which is connected to a supply reservoir for the liquid and to an individual receptacle to be filled by flexible, compressible tubing. Alternately energized alternating current solenoids reciprocate a pivotally mounted lever which alternately closes one of the flexible tubes and opens the other to permit the piston pump to draw liquid from the reservoir and pump it to the receptacle. The valving mechanism includes two adjustable screws, one for each flexible tubing, to pre-compress each tube. Over-compression of the tubes is precluded by an audible warning afforded by the solenoids themselves.

4 Claims, 3 Drawing Figures

Fig. 1.
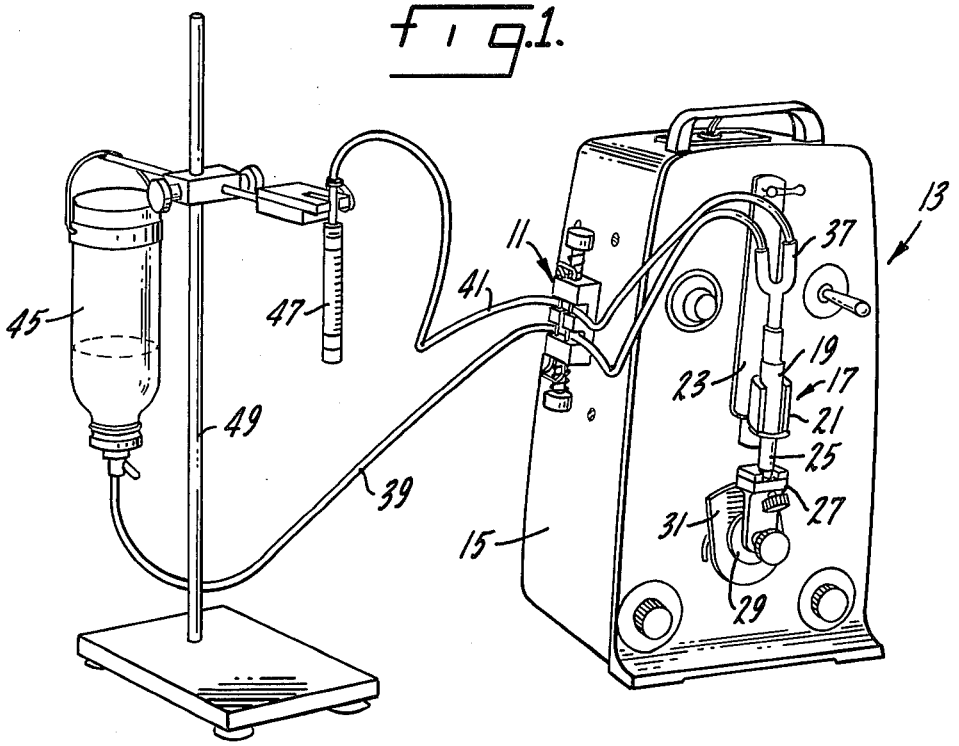
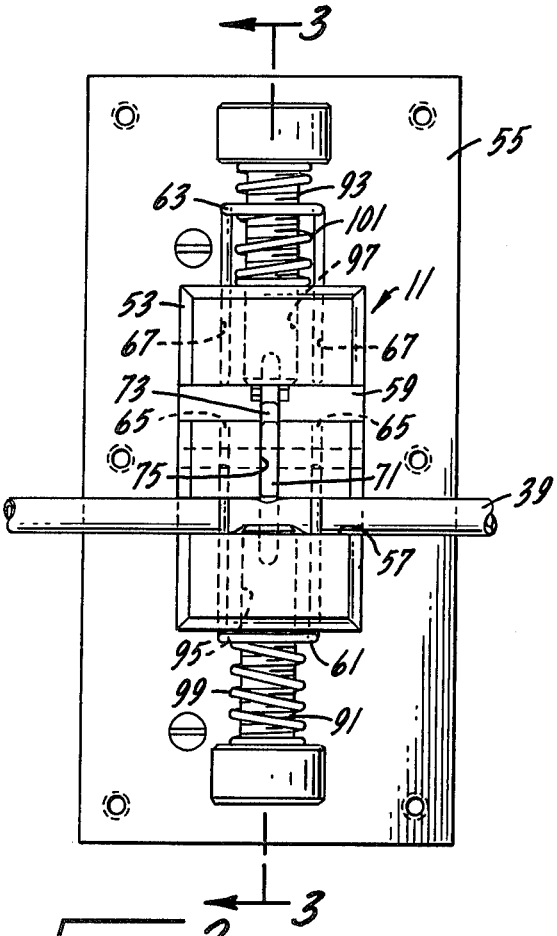
Fig. 2.
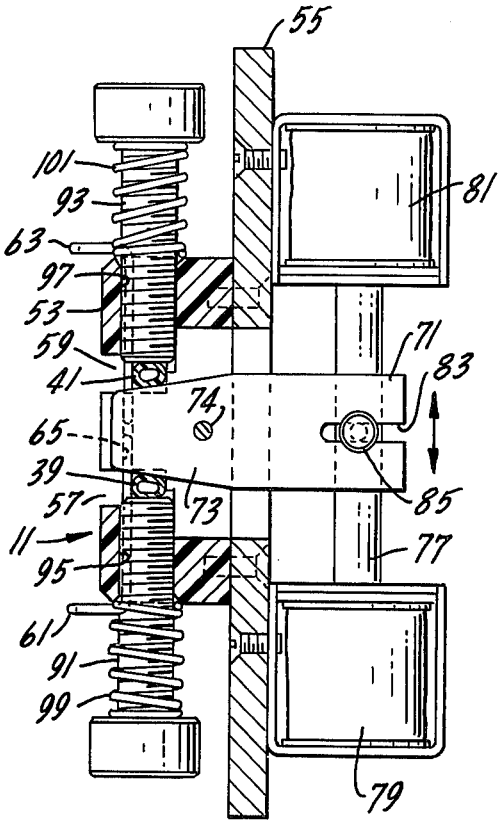
Fig. 3.

AUTOMATIC FILLING MACHINE-VALVE ASSEMBLY

BACKGROUND AND SUMMARY OF THE INVENTION

Automatic filling machines have been used for rapidly and accurately transferring liquid medications in pre-measured doses to receptacles such as oral dispensers, nebulizer injectors, vials and hypodermic syringes. In order to maintain sterility of the medications and to prevent cross contamination, these automatic filling machines have used individually packaged sterile disposable liquid dispensing sets which include a syringe which functions as the pumping mechanism and compressible and flexible plastic tubing connecting the syringe, the reservoir for the medication and the receptacle to be filled. The flexible plastic tubing is fabricated from pharmaceutically acceptable materials such as medical grade polyvinylchloride.

In order to maintain sterility and to prevent cross contamination of the medication being pumped, internal valving is not used. Instead, the flexible tubing is sequentially opened and closed in coordination with the movement of the syringe plunger by a lever which engages the exterior of the flexible tubing and squeezes it closed.

In addition to transferring liquid medications, the automatic filling machines can also be used to transfer premeasured amounts of any liquid from a reservoir to a receptacle. The transfers can be made under sterile or non-sterile conditions.

An object of this invention is an improved valving mechanism for a liquid automatic filling machine which may be used with flexible tubing of various dimensions.

Another object is a valving mechanism for an automatic filling machine having manual adjustment means to vary the amount of compression of the flexible tubing to insure proper opening and closing thereof during dispensing operations.

Another object is an adjustment device for the valving mechanism which audibly indicates excess compression of the flexible tubing.

Accordingly, the invention relates to a valving mechanism for an automatic filling machine of a type having a reciprocating pump driven by a crank arm, a pair of compressible, flexible tubes, one of which connects a reservoir to the pump and the other connects the pump to a receptacle, and electrical switching means coordinated with the rotation of the pump crank arm. The valving mechanism includes means to maintain the compressible, flexible tubes in generally parallel spaced relation to each other. A pivotally mounted lever having an end portion positined between the tubes is formed as part of the valving mechanism. This lever reciprocates about its pivotal mounting to move the end portion of the lever into and out of engagement with one compressible, flexible tube and then the other. Means controlled by the electrical switching means are provided for reciprocating the lever. Means for individually adjusting the position of each tube relative to the end of the lever are provided so that the lever can compress and completely close a tube at the end of its reciprocal movement.

BRIEF DESCRIPTION OF THE DRAWINGS

The invention is illustrated more or less diagrammatically in the following drawings wherein:

FIG. 1 is a perspective view of a filling machine arrangement utilizing the valving mechanism of this invention;

FIG. 2 is an enlarged side elevational view of a valving mechanism of this invention showing the valving mechanism actuated to close the tubing in the lower channel and with the tubing omitted from the upper channel; and FIG. 3 is a cross sectional view taken along line 3—3 of FIG. 2 but modified to show tubing in both channels and the tube closing lever in a neutral position.

DESCRIPTION OF THE PREFERRED EMBODIMENT

A valving mechanism 11 constructed in accordance with the teachings of this invention is shown mounted on a filling machine 13 of the type used for filling receptacles with pre-measured doses of liquid medication. The filling machine includes a housing 15 which contains an electric drive motor and electrical control circuitry which are conventional and are not shown. A pumping mechanism 17 is mounted on the front face of the housing 15. The positions of the pumping mechanism which contact the liquid medication are designed to be both sterile and disposable. The disposable portions include a syringe 19 which is mounted in a syringe holder 21 attached to the lower end of a syringe holder arm 23 which is pivotally mounted on the front face of the housing 15. A syringe plunger rod 25, which is also disposable, extends into the syringe. The lower end of the syringe plunger rod engages and is held by a plunger rod holder 27 which is journalled on an eccentric 29. The eccentric is rotatably mounted on a crank arm 31 attached to a crank shaft (not shown) which connects through a suitable gear mechanism (not shown) to the electric drive motor which is located inside the housing 15.

A disposable Y-shaped fitting 37 is attached to the upper end of the syringe 19. Lengths of compressible flexible plastic tubing 39 and 41 extend from the ends of the Y-shaped fitting respectively to a reservoir 45 and a receptacle 47. The flexible plastic tubing is fabricated from pharmaceutically accepted materials such as medical grade polyvinylchloride. The receptacle 47 may be a syringe, an oral dispenser, a nebulizer injector, or a vial, depending upon the type of liquid medication and the use to which it is to be put. Both the reservoir and the receptacle are supported on a stand 49.

The flexible tubes 39 and 41 extending respectively between the reservoir 45 and receptacle 47 are controlled by the valving mechanism 11. The valving mechanism includes a block 53, preferably formed of a suitable plastic. It is attached to a metal plate 55 which forms part of the housing 15 of the filling machine. Transversely extending channels 57 and 59 are formed in the block 53. Each channel has a width slightly greater than the diameter of the maximum size flexible tubing used with filling machine 13. Likewise, the depth of each channel is sightly greater than the diameter of the maximum size flexible tube. U-shaped wire keepers 61 and 63 are slidably mounted in slots 65 and 67 for movement across the open sides of the channels to retain the tubing in the channels.

A tube compressing and closing lever 71 is pivotally mounted, intermediate its ends, on the block 53 by means of a shaft or pin 74. The lever has a tapered end portion 73 which extends through a slot 75 in the block connecting the channels 57 and 59. The tapered portion 73 of the lever is positioned so as to contact the tubes 39 and 41 located in the channels 57 and 59. The opposite end of the lever 71 extends into the housing 15 where it is connected to a plunger 77, which extends between and constitutes a common core for a pair of spaced alternating current solenoids 79 and 81. The connection between the lever 71 and the plunger 77 includes a slot 83 formed in the lever and a headed pin 85 mounted on the plunger and riding in the slot 83.

Means for adjusting the amount of compression of a flexible tube upon reciprocating movement of the lever 71 are formed as part of the valving mechanism 11. This means includes adjusting screws 91 and 93 which extend through threaded openings 95 and 97 in the block 53 and into the channels 57 and 59. The screws engage the tubing 39 and 41 on the sides thereof opposite to those engaged by the tapered end 73 of the lever 71. Compression springs 99 and 101 are provided for the adjusting screws to retain them in selected positions.

The filling machine 13 incorporating the valving mechanism 11 of this invention may be used in the following manner:

A syringe 19, syringe plunger rod 25, Y-shaped plastic fitting 37 and flexible plastic tubes 39 and 41 are supplied in a sterile pouch when the filling is to be done under sterile conditions. The syringe 19 is removed from the pouch along with the plastic tubes and the Y-shaped fitting. The syringe is installed in the syringe holder 21 and the plunger rod 25 of the syringe is connected to the plunger rod holder 27. The syringe is positioned in the syringe holder so that its flanges abut the bottom of the syringe holder. The flexible tube 41, which is generally marked in a distinctive manner, is inserted into the upper channel 59 of the valve mechanism block 53 after the lever 71 has been pivoted into the lower channel 57. The wire keeper 63 is slid to the channel closing position to retain the tube in the channel. The flexible tube 39 is then installed in the lower channel 57 in the same manner after pivoting of the lever 71 to its upper position. The tubes 39 and 41 are then connected respectively to the reservoir 45 and receptacle 47 which are supported on the stand 49.

Because the flexible tubes 39 and 41 may be of various diameters, it is necessary to provide an adjustment means for the valving mechanism so that the tubing will close properly and open fully upon reciprocating movement of the lever 71 and yet will not be over-compressed during closing operations. The closing force exerted by the lever 71 can be varied by the adjusting screws 91 and 93 acting in combination with the alternating current solenoids 79 and 81. In order to adjust the lower screw 91, the upper solenoid 81 is activated, moving the plunger 77 upwardly and pivoting the tapered end 73 of the lever 71 downwardly, thereby compressing the tube 39 located in the channel 57. The adjusting screw 91 is then rotated in a clockwise direction to move the screw into the channel 57 and toward the tapered end 73 of the lever 71. When the tube 39 is fully compressed between the screw 91 and the lever 71, continued movement of the screw 91 forces the tapered end 73 of the lever 71 in an upwardly direction. The plunger 77 will be pulled downwardly and out of the energized solenoid 81. This will cause a loud humming sound due to the plunger being pulled out of the solenoid against the magnetic force exerted by the solenoid. The loud humming sound indicates over-compression of the tube 39. The threaded member is then rotated in a counterclockwise direction until only a faint hum is heard. The faint hum indicates that the tapered end 73 of the lever 71 is in its lowest position and the tubing 39 is properly compressed against the tapered end of the lever.

The compression of the upper flexible tubing 41 is adjusted in the same manner by energizing the lower solenoid 79 so that the plunger 77 is pivoting the lever 71 against the upper flexible tube 41. With the adjusting screws 91 and 93 properly adjusted for the particular diameters of the tubing being used, the filling machine may now be run through its automatic dispensing cycle to fill the receptacle 47 from the reservoir 45.

In operation, the solenoid 79 is energized in each intake cycle of the pumping mechanism 17, compressing tube 41 while leaving tube 39 open so that a measured quantity of medication is drawn from reservoir 45. For the output cycle of the pumping mechanism, the solenoid 81 is energized to compress tube 39, leaving tube 41 open for delivery of the medication to receptacle 47.

The electrical synchronizing controls of the drive for the pumping mechanism 17 and the valve mechanism 11 may be of conventional construction and hence have not been illustrated.

It should be recognized that an automatic filling machine 13 can be used to transfer liquids other than medications from a reservoir to a receptacle. Thus, the valving mechanism of this invention can be utilized for any pumping operation in which a liquid is transferred from a reservoir to a receptacle. These transferring operations can be conducted under sterile or non-sterile conditions as the nature of the liquid and its use may dictate. Therefore, the scope of this invention should be limited only by the claims that are appended hereto.

We claim:

1. A valving mechanism for an automatic filling machine of the type having a reciprocating pump driven by a crank arm, a pair of compressible, flexible tubes, one of which connects a reservoir to the pump and the other of which connects the pump to a receptacle, and electrical switching means coordinated with the rotation of the pump crank arm, said valving mechanism including:

means to maintain said compressible, flexible tubes in generally parallel spaced relation to each other, a pivotally mounted lever having an end portion positioned between the tubes, said lever being reciprocal about its pivotal mounting to move the end portion into and out of engagement with one tube and then the other, means controlled by the electrical switching means for reciprocating the lever including a pair of alternating current solenoids located in spaced relation to each other and operatively connected by a plunger means, and means connecting said solenoid plunger means to said lever with the connection being located on the opposite side of said lever pivotal mounting from said end portion of the lever, said solenoid plunger means including a rod which is a common plunger for both solenoids, said means connecting said solenoid plunger means to said lever including a pin attached to said common plunger rod and riding in a slot formed in said lever, and means for individually adjusting the position of each tube relative to the end of the lever so that the lever can compress and completely close a tube at the end of its reciprocal movement.

2. The valving mechanism of claim 1 in which said means to maintain said compressible, flexible tubes in generally parallel spaced relationship to each other includes:

a pair of spaced parallel channels each of which is dimensioned to receive one of said compressible flexible tubes, and means to close the open side of each channel to retain a tube in the channel.

3. The valving mechanism of claim 2 in which said means to close the open side of said channel includes a bent wire member slidable across the open side of said channel.

4. The valving mechanism of claim 1 in which said means for individually adjusting the position of each tube relative to the end of the lever includes a pair of threaded members located on opposite sides of the end portion of said lever and aligned with the path of reciprocal movement of the end of said lever, each threaded member being movable into contact with its flexible tube so as to move the tube toward and against the end portion of said lever.

* * * * *